United States Patent [19]

Orova et al.

[11] 4,175,509

[45] Nov. 27, 1979

[54] MAGNETO IGNITION SYSTEM FOR AN INTERNAL COMBUSTION ENGINE

[75] Inventors: Josef Orova, Schwabach; Jiri Podrapsky, Buchschwabach, both of Fed. Rep. of Germany

[73] Assignee: Robert Bosch GmbH, Stuttgart, Fed. Rep. of Germany

[21] Appl. No.: 869,617

[22] Filed: Jan. 16, 1978

[30] Foreign Application Priority Data

Jan. 18, 1977 [DE] Fed. Rep. of Germany ..... 2601750

[51] Int. Cl.[2] ..... F02P 3/02

[52] U.S. Cl. ..... 123/117 R; 123/149 C; 315/218

[58] Field of Search ..... 123/149 C, 148 E, 149 R, 123/148 AC, 117 R; 315/218, 209 M; 322/17, 91, 94

[56] References Cited

U.S. PATENT DOCUMENTS

| | | | |
|---|---|---|---|
| 3,651,795 | 3/1972 | Noddin | 123/149 C |
| 3,864,621 | 2/1975 | Haubner et al. | 123/148 E |
| 3,864,622 | 2/1975 | Haubner et al. | 123/148 E |
| 3,878,452 | 4/1975 | Haubner et al. | 322/17 |
| 3,878,824 | 4/1975 | Haubner et al. | 315/218 |
| 3,881,458 | 5/1975 | Roozenbeek et al. | 123/117 R |
| 3,894,525 | 7/1975 | Haubner et al. | 315/209 M |
| 3,898,972 | 8/1975 | Haubner | 123/117 R |
| 4,085,714 | 4/1978 | Hattori et al. | 123/117 R |
| 4,095,576 | 6/1978 | Hattori et al. | 123/148 E |
| 4,112,890 | 9/1978 | Manger et al. | 123/117 R |

*Primary Examiner*—Charles J. Myhre
*Assistant Examiner*—R. A. Nelli
*Attorney, Agent, or Firm*—Frishauf, Holtz, Goodman & Woodward

[57] ABSTRACT

To provide for ignition advance as the speed of the engine increases, a frequency-dependent circuit formed by a series RC circuit is connected in parallel with the control path of a switch in series with the primary of the magneto ignition coil so that the switch will be controlled to cut off or to open earlier as the speed increases.

7 Claims, 4 Drawing Figures

MAGNETO IGNITION SYSTEM FOR AN INTERNAL COMBUSTION ENGINE

The present invention relates to a magneto ignition system for an internal combustion engine, and more particularly to a transistor-controlled ignition system in which a transistor switch is controlled to open at the ignition instant.

BACKGROUND AND PRIOR ART

Various types of magneto ignition systems are known; the present invention is specifically directed to a magneto system in which a primary of a magneto ignition coil is magnetically coupled to a field rotating in synchronism with rotation of the engine. The secondary of the coil is connected to a spark plug. The ignition instant itself is determined by a control circuit, likewise coupled to the primary, which first controls a transistor to be conductive so that current can flow through the magneto ignition coil primary to store magnetic energy therein, and then is controlled, suddenly, to cut off, the sudden interruption of current flow inducing a voltage in the secondary which triggers the spark in the spark plug. In such systems, a positive voltage half-wave in the primary first controls the ignition transistor to be conductive. At about the peak value of the voltage half-wave, a threshold switch is triggered which, in turn, controls the ignition transistor to cut off. Adjustment of the ignition timing with respect to the magneto is obtained by generating auxiliary voltage half-waves, first a small voltage half-wave and subsequently a greater positive half-wave. In low-speed ranges of the machine, only the larger voltage half-wave will cause the threshold switch to respond. Since, as the speed increases, the voltage in the primary also rises, the threshold switch will respond at high speed ranges already when the earlier, and smaller voltage half-wave occurs, since under high-speed conditions, the smaller voltage half-wave will have reached the threshold level. Thus, at a certain critical speed, the ignition timing is advanced by a fixed amount in the direction of spark advance.

The efficiency of operation of internal combustion engines which operate within wide speed ranges is poor in an intermediate speed range if the ignition timing at that intermediate speed range is not matched to the actual engine speed. Changing ignition timing in jumps by a fixed values is undesirable when the engine is not operating either at a low idle speed or at a high speed, but is apt to be operated over wide ranges of speed. The generation of a separate half-wave control voltage to trigger the threshold switch at high-speed operation requires additional apparatus in the primary circuit, which is costly and undesirable from the manufacturing point of view.

THE INVENTION

It is an object to provide an electronically controlled ignition system in which the ignition timing advance is essentially uniform as speed increases and can be matched to the most efficient or desirable speed-ignition advance characteristics of the engine, and which requires but little in the way of apparatus or circuitry and operates reliably and efficiently over the entire design range of speed of the engine.

Briefly, a series resistance-capacitance (R/C) circuit is connected in parallel to the control path of the semiconductor switch in the primary circuit of the magneto ignition system, typically in parallel to the base-emitter of the transistor. The instant of cut-off of the switch is thus changed as the speed of the engine is increased in the direction of advance of the ignition instant.

In accordance with a feature of the invention, a speed-responsive switch, which may be a transistor switch, is connected in series with the R/C circuit so that it will not become effective until a certain speed, for example somewhat in excess of idling speed, has been reached so that at lower speed ranges there is little change in spark advance. Thus, the speed-spark advance curve obtained will not have an essentially uniform slope but, rather, an essentially flat initial portion.

The system has the specific advantage with respect to the above referred-to prior art system that the ignition timing can be changed smoothly over the entire speed range of the engine, and controlled by only a single half-wave generated in the primary of the ignition coil for any one ignition event. This substantially simplifies the construction of the ignition system. Locating the R/C element in parallel to the control path of the ignition transistor additionally provides for a shorter time during which the ignition transistor approaches saturation, or has reached saturation, so that, as the speed increases, the overall time during which the transistor is in saturation will be less, thus limiting the current consumption in the primary circuit and increasing the primary voltage. Raising of the primary voltage causes triggering of the ignition at an earlier instant, as the speed increases. By suitable dimensioning and matching of the R/C element to the remaining elements of the ignition system it is thus possible to obtain ignition-speed characteristics which are well matched to the engines with which they are to be used.

The fuel-air mixture is burned as completely as possible if, at lower speed ranges, and particularly upon idling, the ignition timing is close to the top dead center (TDC) position of the piston and is advanced with respect to this timing only as the speed has exceeded a certain level—but, in contrast to the prior art, is advanced gradually and smoothly. Thus, for lower speed ranges, it may be desirable to utilize the preferred feature of the invention in which the R/C circuit is placed in circuit, or enabled, only after a certain critical speed has been exceeded.

Drawings, illustrating an example:

Figure 1:
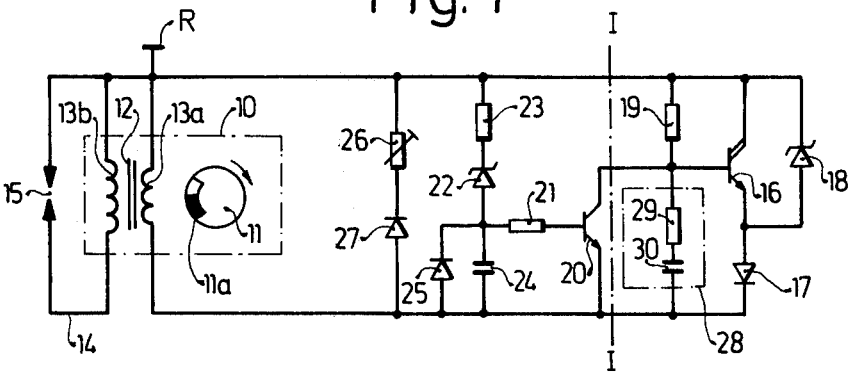
FIG. 1 is a schematic circuit diagram of the ignition system.

The magneto ignition system of FIG. 1 controls ignition of a single cylinder internal combustion engine. The magneto 10 has a rotating magnet 11 coupled to the engine and rotating therewith. It has a permanent magnet 11*a*, located between a pair of pole shoes, secured, for example, to the outer circumference of a flywheel or a cooling fan wheel of the internal combustion engine. The magneto system 10 cooperates with and is magnetically coupled to a fixed armature 12 located on a core and secured to the frame of the machine. The armature 12 is simultaneously the armature cooperating with the magnet 11*a* and the ignition coil. Thus, the armature has a primary winding 13*a* and a secondary winding 13*b*, the secondary being connected by ignition cable 14 to a spark plug 15. The primary 13*a* is connected to a primary circuit, in which an npn ignition transistor 16 is connected. Ignition transistor 16 is a Darlington switching transistor, the collector of which is connected to the grounded or chassis terminal of the primary 13*a*, the emitter of which is connected through a reverse polarity protective diode 17 to the other terminal of the primary 13*a*. The direction of polarity of diode 17 is the same as the direction of the main current path of the ignition transistor 16. The ignition transistor is protected against over-voltages by a Zener diode 18, connected thereacross and reversely poled. The base of the ignition transistor 16 is connected over a resistor 19 to the collector of the ignition transistor 16. The control path of the ignition transistor 16, that is, the base-emitter path thereof, is connected to a control circuit which has a control switch formed by an npn transistor 20 to control the control path of the ignition transistor 16 which is connected in parallel to the main current path of the control transistor 20. The base of the control transistor 20 has its control potential applied over a coupling resistor 21 which is connected to the junction of a voltage sensing threshold circuit. This threshold circuit is formed by a Zener diode 22, serially connected through a resistor 23 to the chassis or ground terminal of the ignition coil 13*a*. The junction between the Zener diode 22 and the coupling resistor 21 is connected to the parallel circuit formed by a capacitor 24 and a diode 25 operating as a decoupling diode. The Zener diode 22 as well as the decoupling diode 25 are so poled that they will pass those half-waves derived from the coil 13*a* which are not necessary to cause current flow through the transistor 16, and to cause ignition. The primary winding 13*a* of the magneto armature 12 is additionally bridged by a half-wave suppression circuit formed by a resistor 26 and a diode 27, both poled similarly to diodes 22, 25, blocking half-waves required for ignition but passing half-waves not required for ignition. By suitable adjustment of the resistor 26, or selection of one or more resistors instead of resistor 26, those half-waves which are not needed for generation of an ignition can be suitably damped or suppressed.

In accordance with the invention, ignition timing is adjusted with respect to speed by advancing the ignition by including an R/C circuit 28 in parallel to the control path, that is, the base-emitter path of the switching transistor 16. For simplicity, circuit 28 is connected across the base-emitter-diode 17 circuit, but it could be connected only across the transistor 16. The R/C circuit 28 has a resistor 29 and a capacitor 30.

Figure 2:
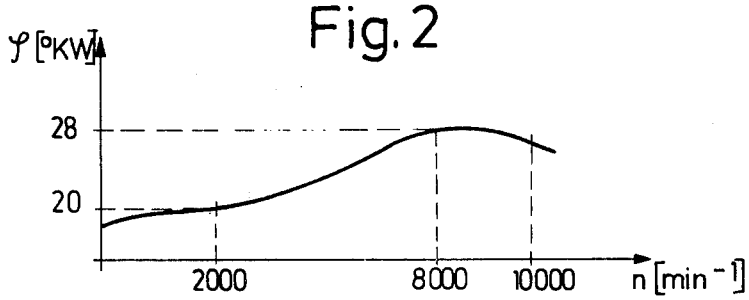
FIG. 2 is a graph of speed (abscissa) vs. crankshaft angle (ordinate) illustrating ignition timing, the speed being in rpm.

Operation, with reference to FIG. 2: At idle speed, the ignition timing should preferably be so set that for many one-cylinder engines the spark is triggered at 20° crankshaft angle rotation in advance of top dead center (TDC) position of the piston, that is, the angle is +20° KW, as indicated in FIG. 2. As the speed increases, the ignition timing should be smoothly increased in the direction of ignition advance so that, at an upper speed range, a maximum of 28° crankshaft angle in advance of TDC position should be obtained for the ignition event.

In operation of the engine, the magneto system 11 causes positive and negative voltage half-waves in the primary 13*a* of the armature 12. Looked at from the grounded or chassis or reference connection of the primary 13*a*, as indicated by terminal R, the positive half-waves are damped by the resistor-diode circuit 26, 27 to such an extent that voltage peaks will not affect the remaining components or elements of the ignition system. The negative voltage half-waves are used to generate the ignition spark at any ignition event, and additionally to provide a control signal to control the timing thereof.

Upon the beginning of any negative half-wave, control current will first flow through resistor 19 to the control path of the ignition transistor 16 and will control transistor 16 to become conductive. Primary current will now flow through the coil 13*a* and the ignition transistor 16. When the primary voltage reaches a certain threshold value, for example about 4 V, which is applied to the Zener diode 22, Zener diode 22, becomes conductive and control current will flow through resistor 23 to charge capacitor 24. Diode 25, under those conditions, is blocked. As the control voltage at the capacitor 24 rises, the response or trigger voltage of transistor 20 will be reached. The base of transistor 20 is coupled through resistor 21 to the capacitor 24, so that the control transistor 20 will become conductive, bridging with its now conductive main current path the control path of the transistor 16 which will cause transistor 16 to block instantly. Primary current is suddenly interrupted so that a sharp voltage pulse will be induced in the secondary 13*b*, causing arc-over at spark plug 15. The resistance 21 at the base of the control transistor 20 delays discharge of the capacitor 24. The voltage pulse in the primary 13*a* is also applied through the Zener diode 22 to the base of the control transistor 20 which ensures that the control transistor remains conductive and the ignition transistor 16 will reliably remain in blocked state during the entire ignition event. The voltage pulse in the primary 13*a* is limited to a safe value of, for example, about 300 V, by the Zener diode 18.

In ignition systems of this type, the negative half-wave necessary for ignition is somewhat delayed as the speed increases. This is due to the mechanical construction of such ignition systems. Since, however, as the speed increases, the voltage rise at the voltage half-wave becomes steeper, the ignition timing is approximately constant in intermediate ranges of speed, and over a rather wide range at that, absent special provisions.

In accordance with the present invention, the R/C circuit 28 connected across the control path of the transistor 16 forms a frequency-dependent resistance network, the resistance of which decreases as the speed increases, that is, the resistance of which decreases with increasing frequency. Consequently, the voltage at the base of the ignition transistor 16 is decreased already before the ignition instant, as commanded by transistor 20, so that the ignition transistor 16 is driven into saturation range to a lesser extent. The saturation or short-circuit current flowing through the transistor 16 of the primary current circuit is thereby limited, thus increasing the primary voltage. Increase of the primary voltage causes the Zener diode 22 to break down earlier, thus shifting the ignition instant towards spark advance.

Changing the ignition instant to a greater spark advance is desirable to improve the efficiency of operation of the internal combustion engine, and the combustion occurring therein.

The graph of FIG. 2 shows the approximate change of timing of the ignition instant as a function of speed in rpm. By suitable dimensioning of the R/C network 28, and matching the networks to the remaining components of the circuit, various shapes of the graph of FIG. 2 can be obtained. It may be desirable, for example, not only to control ignition timing to be essentially smooth with respect to spark advance over the entire speed range but additionally to change the ignition timing to a lesser advance when the engine operates at low-speed ranges or at idle range. This can be obtained by setting a certain critical or predetermined speed which causes operation of the circuit of FIG. 1 as if the R/C network 29, 30 were not present and to engage the network 28 only after the critical or minimum or predetermined speed has been exceeded.

Figure 3:
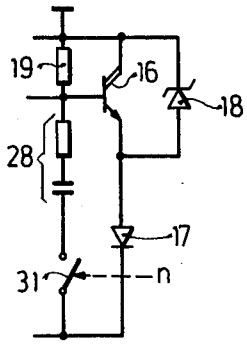
FIG. 3 is a fragmentary diagram showing a modification of the circuit to the right of the line I—I of FIG. 1.

FIG. 3 illustrates the arrangement in which the circuit 28 is serially connected with a switch 31, switch 31 being closed only after a certain, predetermined or critical speed has been reached. Switch 31 is open in low-speed ranges, so that the R/C circuit 28 will not cause spark advance. The switch 31 may, for example, be a centrifugal switch, closed when the critical speed is reached. At that instant, the R/C element will become fully effective and will cause a sudden jump in spark timing in the direction of spark advance. This jump may be very small, however. As the speed increases, the further advance of the spark will be gradual and smooth, depending on the decreasing effective resistance of the R/C circuit 28 as the speed and hence the frequency increases.

Figure 4:
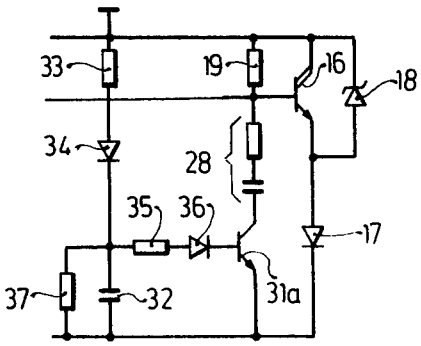
FIG. 4 is a fragmentary circuit diagram showing another embodiment of the circuit to the right of the line I—I of FIG. 1.

FIG. 4 illustrates the circuit in which the switch 31 is replaced by a transistor 31*a*. The base-emitter path of the transistor is coupled through a resistor 35 and diode 36 to a capacitor 32 which is connected across the primary coil 13*a*, forming a speed sensing circuit, similar to the circuit 22, 23, 24 of FIG. 1. A resistor 37 is connected in parallel to the capacitor 32. Diode 34 is a decoupling diode to prevent charge of the capacitor 32 by positive half-waves. Capacitor 32 is connected by the resistor-diode network 35, 36 with the base of the transistor 31*a*.

Operation, circuit of FIG. 4: In low-speed ranges, insufficient current will flow through the network 32, 33, 34 to control transistor 31*a* to be conductive, since capacitor 32 cannot be charged sufficiently due to the presence of resistor 33. Capacitor 32, further, is discharged over the resistor 37 each time the negative voltage half-wave has disappeared. As the speed increases, however, the charge on capacitor 32 will increase due to the speed-dependent primary voltage which rises before the ignition event is triggered. As the speed increases, capacitor 32 will no longer be completely discharged over resistor 27 before the next voltage half-wave appears. The voltage, therefore, rises across the capacitor 32 until it reaches a value at which, when the voltage is applied over coupling resistor 35 and diode 36 to the transistor 31*a*, the transistor 31*a* will be conductive, thus effectively connecting the R/C circuit 28 in parallel to the control path of the transistor 16. At that speed, which forms a critical or predetermined speed, the ignition timing is advanced in the direction of ignition advance, and from that point on the timing will change smoothly as a function of speed and not abruptly, as upon closing of the switch 31*a*.

In an example of a magneto circuit, the following component values were used:

resistor 23: 1500 Ohms
Zener diode 22: 3,9 Volts
capacitor 24: 0,22 micro Farads
resistor 19: 560 Ohms
resistor/capacitor network 28: 220 Ohms/0,47 micro Farads
resistor 33: 1000–10,000 Ohms
capacitor 32: 4–10 micro Farads
resistor 37: 1000–50,000 Ohms
change of resistance of transistor 16 at 8000 rpm (FIG. 2) from 0,6 Ohms to 1,5 Ohms upon insertion of circuit 28.
change in voltage level across primary circuit at 8000 rpm (FIG. 2) from 0,2 to 0,3 volts upon insertion of circuit 28.

Various changes and modificatins may be made, and features described in connection with any one of the embodiments may be used with any of the others, within the scope of the inventive concept.

We claim:

1. In a magneto ignition system for an internal combustion engine having a magnet (11) rotating with the engine;

a magneto armature (12) in magnetically coupled relation to the rotating magnet and having a primary coil (13*a*) connected to a primary circuit, and a secondary coil (13*b*) connected to a spark plug (15);

a semiconductor switch (16) having a control path (base-emitter) connected in the primary circuit;

a control circuit (20–25) connected to the control path of the semiconductor switch (16) and to the primary circuit of the ignition coil, including means (22) sensing the voltage level across said primary circuit, and connection means (20, 21) responsive to said voltage level connected to and controlling conduction and cut-off, respectively, of the semiconductor switch as a function of said voltage level to provide, upon conduction of the semiconductor switch, for current flow through the primary coil, and sudden interruption of current flow upon cut-off and to generate a spark in said spark plug at a predetermined angular position with respect to top dead center (TDC) position of a piston of the engine, means to advance the spark upon increase of speed of the engine comprising means (28, 29, 30) modifying the voltage level across said primary circuit as a function of increasing speed of the engine in a direction to cause response of said voltage level sensing means, and hence of said connection means to control said semiconductor switch (16) to cut off at an advanced angular position with respect to TDC position of a piston of the engine, said modifying means comprising a frequency responsive circuit (28, 29, 30) connected to the primary circuit and providing an output changing the voltage level in said primary circuit as a function of change of frequency of the current flow in the primary circuit upon change of speed of rotation of the magnet as the speed of the engine changes.

2. System according to claim 1, wherein said semiconductor switch is a transistor (16);

and said primary voltage modifying means comprises a circuit (28) responsive to increasing speed of the engine to control the base of said transistor (16) to assume a higher resistance value to thereby increase the voltage in the primary circuit.

3. System according to claim 1, wherein said frequency-responsive circuit (28; 29, 30) comprises a series resistance/capacitance circuit connected in parallel to the control path (base-emitter) of the transistor (16) in the primary circuit to change the resistance value thereof, and hence the instant of cut-off of the switch with change in speed of the engine to advance the ignition instant as the speed increases.

4. System according to claim 3, further including a speed-responsive switch (31, 31*a*) serially connected with the series R/C circuit (28).

5. System according to claim 4, wherein the speed-responsive switch comprises a transistor (31*a*), a capacitor (32) connected in parallel to the emitter-base path of the transistor, and a charge circuit (33, 34) connected to the primary circuit to control conduction of said speed responsive switching transistor (31*a*) as a function of the voltage level, and hence speed in the primary circuit.

6. System according to claim 5, further including a coupling circuit having a resistor (35) and a diode (36) connecting the capacitor (32) and the base of the speed-responsive switching transistor (31*a*)

7. System according to claim 6, further including a discharge resistor (37) connected across the capacitor (32).

* * * * *

UNITED STATES PATENT AND TRADEMARK OFFICE

CERTIFICATE OF CORRECTION

PATENT NO. : 4,175,509

DATED : November 27, 1979

INVENTOR(S) : Josef OROVA and Jiri PODRAPSKY

It is certified that error appears in the above—identified patent and that said Letters Patent is hereby corrected as shown below:

On The Title Page, Item (30), should read

--Foreign application priority data

January 18, 1977 (DE)

Fed. Rep. Germany

2701750 --.

Signed and Sealed this

*Ninth* Day of *June 1981*

[SEAL]

*Attest:*

RENE D. TEGTMEYER

*Attesting Officer*

*Acting Commissioner of Patents and Trademarks*